US008800236B2

(12) United States Patent
Yong et al.

(10) Patent No.: US 8,800,236 B2
(45) Date of Patent: Aug. 12, 2014

(54) CONSTRUCTION BLOCK

(75) Inventors: David Hsien Ta Yong, North Perth (AU); Han Chuan Khor, Nedlands (AU); Arcady Victorovich Dyskin, Crawley (AU); Elena Pasternak, Crawley (AU); Juri Sacharowitsch Estrin, Mount Waverley (AU)

(73) Assignee: Tetraloc Pty Ltd, North Perth (AU)

( * ) Notice: Subject to any disclaimer, the term of this patent is extended or adjusted under 35 U.S.C. 154(b) by 0 days.

(21) Appl. No.: 13/825,994

(22) PCT Filed: Sep. 30, 2011

(86) PCT No.: PCT/AU2011/001256

§ 371 (c)(1),
(2), (4) Date: May 30, 2013

(87) PCT Pub. No.: WO2012/040789

PCT Pub. Date: Apr. 5, 2012

(65) Prior Publication Data

US 2013/0247503 A1 Sep. 26, 2013

(30) Foreign Application Priority Data

Oct. 1, 2010 (AU) ..... 2010904412

(51) Int. Cl.
*E04B 1/02* (2006.01)

(52) U.S. Cl.
USPC ..... 52/604; 52/574

(58) Field of Classification Search
USPC ..... 52/569, 590.2, 592.4–592.6, 570, 52/604–607, 609, 646, 582.1, 574, 575, 52/232; D25/113, 114, 115, 116, 117, 118
See application file for complete search history.

(56) References Cited

U.S. PATENT DOCUMENTS

| | | | | | |
|---|---|---|---|---|---|
| 468,838 | A | * | 2/1892 | Steiger | 52/284 |
| 1,071,803 | A | * | 9/1913 | Schmitz | 52/855 |
| 1,689,107 | A | * | 10/1928 | Bradley | 52/592.3 |
| 2,019,653 | A | * | 11/1935 | Buyer | 52/592.5 |
| 2,392,551 | A | | 5/1943 | Roe | 72/38 |
| 2,472,363 | A | * | 6/1949 | Blackinton | 446/127 |
| 3,229,439 | A | * | 1/1966 | Strobel | 52/591.2 |
| 3,435,576 | A | * | 4/1969 | Giannelia | 52/300 |
| 3,440,784 | A | * | 4/1969 | Onjukka | 52/233 |
| 3,534,518 | A | | 10/1970 | Zagray | 52/258 |
| 3,618,279 | A | * | 11/1971 | Sease | 52/223.7 |
| 3,888,060 | A | | 6/1975 | Haener | 52/286 |

(Continued)

FOREIGN PATENT DOCUMENTS

| | | | |
|---|---|---|---|
| CA | 1081911 | 7/1980 | E04B 1/12 |
| FR | 2 296 741 | 1/1975 | E04C 1/04 |

(Continued)

OTHER PUBLICATIONS

Form PCT/ISA/210—Int'l Search Report (from corresponding Int'l Patent App. No. PCT/AU2011/001256—1 page.

*Primary Examiner* — Robert Canfield
*Assistant Examiner* — Babajide Demuren
(74) *Attorney, Agent, or Firm* — Kusner & Jaffe

(57) ABSTRACT

An interlocking construction block has opposed ends each having a plurality of substantially planar bearing surfaces. The planar surfaces include perpendicular surfaces joined by surfaces at obtuse angles. The block is arranged to be complementary to other blocks in several different configurations.

11 Claims, 10 Drawing Sheets

(56) References Cited

U.S. PATENT DOCUMENTS

| | | | | | |
|---|---|---|---|---|---|
| 4,016,692 | A | * | 4/1977 | Jordan et al. | 52/314 |
| 4,035,975 | A | * | 7/1977 | Gergely | 52/284 |
| 4,040,226 | A | * | 8/1977 | Fernaeus et al. | 52/592.6 |
| 4,124,961 | A | | 11/1978 | Habegger | 52/592 |
| 4,367,615 | A | | 1/1983 | Feldman | 52/583 |
| 4,441,298 | A | * | 4/1984 | Limousin | 52/592.2 |
| 4,593,513 | A | * | 6/1986 | Stratton | 52/578 |
| 5,647,185 | A | | 7/1997 | Forlini | 52/604 |
| 6,665,994 | B1 | * | 12/2003 | Ruggeri | 52/592.6 |
| 6,679,022 | B1 | * | 1/2004 | Corporaal | 52/604 |
| 2009/0113836 | A1 | * | 5/2009 | Pitchers et al. | 52/604 |
| 2010/0043335 | A1 | * | 2/2010 | O'Connor | 52/592.6 |

FOREIGN PATENT DOCUMENTS

| | | | |
|---|---|---|---|
| GB | 508987 | 7/1939 | E04B 2/16 |
| NL | 6914433 | 4/1970 | E04B 2/16 |
| WO | WO 79/00198 | 4/1979 | E04C 1/08 |

* cited by examiner

CONSTRUCTION BLOCK

FIELD OF THE INVENTION

The present invention relates to construction or building blocks having complementary-shaped surfaces to restrain relative movement.

BACKGROUND TO THE INVENTION

The use of traditional bricks-and-mortar construction presents some well-known limitations in building. These limitations include the need for skilled labour to achieve an even, square result; limitations in the speed at which a structure can be erected due, for instance, to the requirement for mortar to cure; and limitations in the compressive load carrying ability of the structure due to the variation in stiffness between bricks and mortar.

The use of pre-cast concrete panels has become more common in recent years, in an attempt to ameliorate some of these limitations. The use of such panels has its own limitations, including difficulties in adapting panels to a particular site, and the need for mechanised equipment during movement and installation of the panels.

In another alternative to traditional bricks-and-mortar construction, interlocking building blocks have been used in some applications. One example of this is the Haener block, shown in U.S. Pat. No. 3,888,060. The Haener block has interlocking tongue-and-groove style projections between adjacent blocks. Also available are building blocks having projections on one side and corresponding recesses on an opposing side. An example is the Habegger block, shown in U.S. Pat. No. 4,124,961. This style of block has complementary upper and lower surfaces, with projections on a lower surface which locate within hollows on an upper surface.

The advantage of interlocking building blocks is that they are largely self-locating, and do not require mortar, thus allowing for the quick erection of structures by largely unskilled labour.

It is also known to use interlocking blocks in the laying of segmental block paving. Traditional paving methods rely on frictional engagement between adjacent paving bricks to prevent movement of the paving under load. The effectiveness of this is reliant on many factors, including the paver shape, the laying pattern, and the properties of the joint sand and the bedding sand. These factors are difficult to quantify and thus control.

In an attempt to ameliorate these problems, systems of interlocking blocks, such as those described in U.S. Pat. No. 6,988,847, have been employed as paving blocks.

All of the interlocking block systems described above have been designed to suit a specific construction purpose. It is considered desirable to create a construction block design which can be used for both building and paving, as well as other applications. The present invention seeks to meet this desire.

The present invention employs the principle of topological interlocking, where surfaces of adjacent blocks are of complementary shape. An example of this principle can be found in GB 1,533,980, which proposes building blocks having sides which follow a sinusoidal curve.

A significant limitation of this design is that unless adjacent blocks are perfectly aligned, significant stress concentrations can occur at the resulting point or line loading points. The design also requires a high degree of accuracy in manufacture. The present invention proposes an alternative construction block design in light of the difficulties of the prior art.

SUMMARY OF THE INVENTION

According to one aspect of the present invention there is provided a construction block having a first end and a second end; each of the first end and the second end having a plurality of substantially planar bearing surfaces, at least two of the bearing surfaces being relatively disposed at an obtuse angle, wherein an engaging portion of the first end of a first block is complementary in shape to an engaging portion of the second end of a second block, and whereby the first end of the block includes at least one outermost bearing surface furthest from the second end and at least one innermost bearing surface closest to the second end, both the innermost and outermost bearing surfaces being adjacent a periphery of the first end.

It is preferred that the block has a length which is twice its width, and that the engaging portions can be engaged when the first block is offset relative to the second block by half the block's length. It will be appreciated that in this arrangement the engaging portions are substantially square, and that each end of the block has two engaging portions located side-by-side.

It is further preferred that each engaging portion is symmetrical about a diagonal, such that the first block can be arranged to be perpendicular to the second block with the engaging portions in engagement.

In a preferred embodiment of the invention, some of the bearing surfaces are substantially perpendicular to side walls of the block. These bearing surfaces, which are horizontal when the side walls are vertical, may be located at two heights, with angled bearing surfaces extending between horizontal surfaces at different heights. It will be appreciated that when the side walls are vertical, and the first end located at the top of the block, the highest horizontal bearing surface is the outermost bearing surface, and the lowest horizontal bearing surface is the innermost bearing surface. It is preferred that each engaging portion has two highest horizontal bearing surfaces, located at diagonally opposed corners of the engaging portion; and two lowest horizontal bearing surfaces located at the other corners of the engaging portion. The horizontal bearing surfaces may each be square, with a side length approximately equal to one quarter of the block width.

It is also preferred that each engaging portion has a point at which at least four bearing surfaces meet. This point may be centrally located, and may represent a point of inflexion.

Adjoining engagement portions are preferably reflected about the middle of a block, such that the bearing surfaces located along the middle of a block end are substantially continuous between the two engaging portions.

It is preferred that the block be symmetrical about a plane of symmetry located midway between the first end and the second end, perpendicular to the side walls.

BRIEF DESCRIPTION OF THE DRAWINGS

It will be convenient to further describe the invention with reference to preferred embodiments of the construction block of the present invention. Other embodiments are possible, and consequently the particularity of the following discussion is not to be understood as superseding the generality of the preceding description of the invention. In the drawings:

FIG. 5(*b*) is a perspective of alternative paving using the blocks of FIG. 1;

DETAILED DESCRIPTION OF PREFERRED EMBODIMENTS

Figure 1:
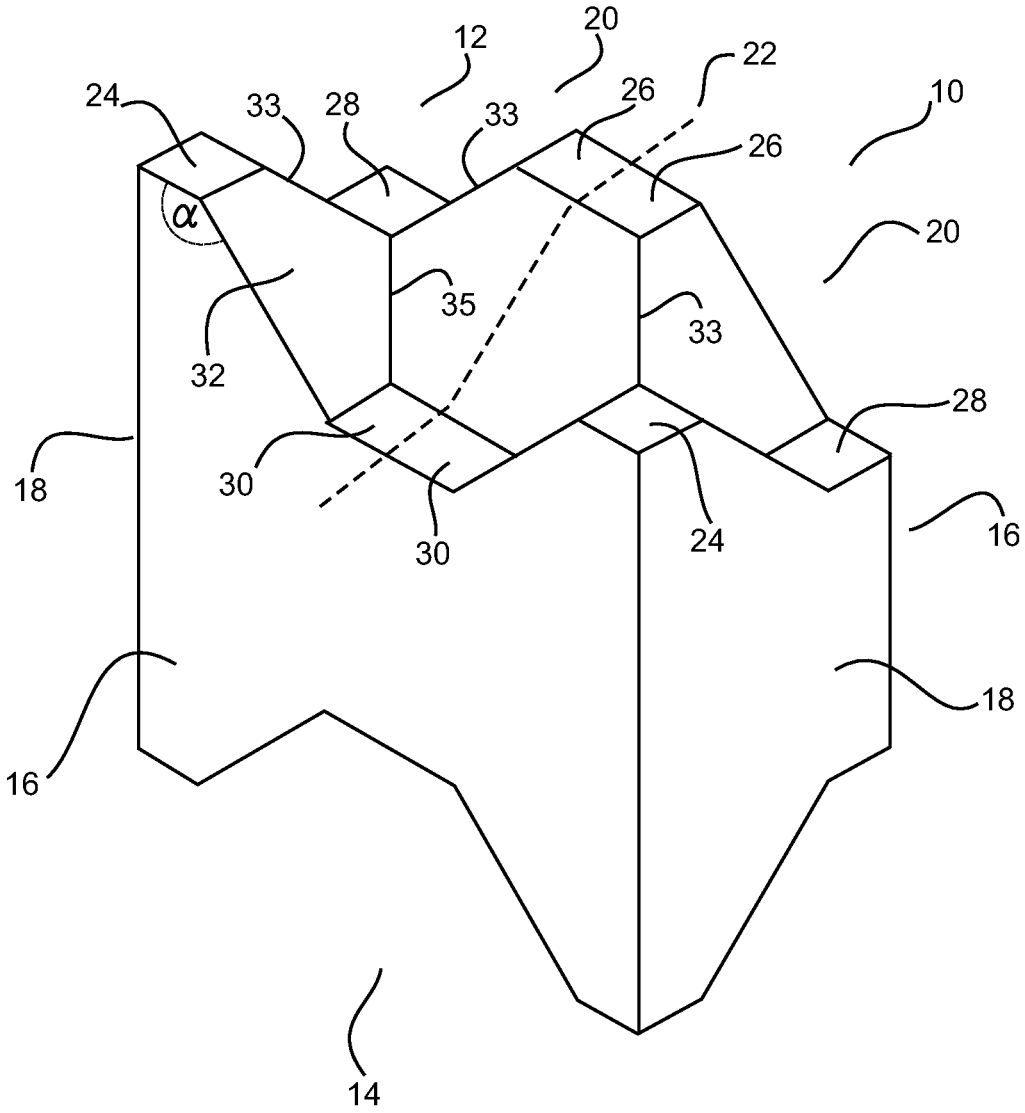
FIG. 1 is a perspective of a construction block in accordance with the present invention.

Referring to the Figures, FIG. 1 shows a construction block 10 having a first end 12, a second end 14, two first side walls 16 and two second side walls 18. When the block 10 is held in the position of FIG. 1, the first and second side walls 16, 18 are all vertical, planar surfaces.

The first side walls 16 are twice the width of the second side walls 18, meaning that if a horizontal cross section were taken through centre of the block 10 the result would be a rectangle with a length twice its width.

The first end 12 has a plurality of bearing surfaces, including horizontal bearing surfaces and angled bearing surfaces as will be described in greater detail below. The angled bearing surfaces each make an obtuse angle with respect to the horizontal bearing surfaces. In some cases the angled bearing surfaces also make an obtuse angle with respect to each other.

For the purposes of description, the first end 12 can be divided into two engaging portions 20, by drawing an imaginary dividing line 22 parallel to the second side walls 18, mid-way through the first side walls 16. Each of the engaging portions 20 is square when viewed from above.

Each of the engaging portions 20 has four horizontal bearing surfaces: a first high horizontal bearing surface 24 located at an outer corner of the first end 12; a second high horizontal bearing surface 26 located at a diagonally opposed corner of the engaging portion 20, along the dividing line 22, and at the same height as the first high horizontal bearing surface 24; a first low horizontal bearing surface 28 located at the other outer corner of the first end 12; and a second low horizontal bearing surface 30 diagonally opposed to the first low horizontal bearing surface 28, and at the same height as the first low horizontal bearing surface 28. Each of the four horizontal bearing surfaces is square, with a side length equal to one quarter of the width of the block 10.

Figure 2:
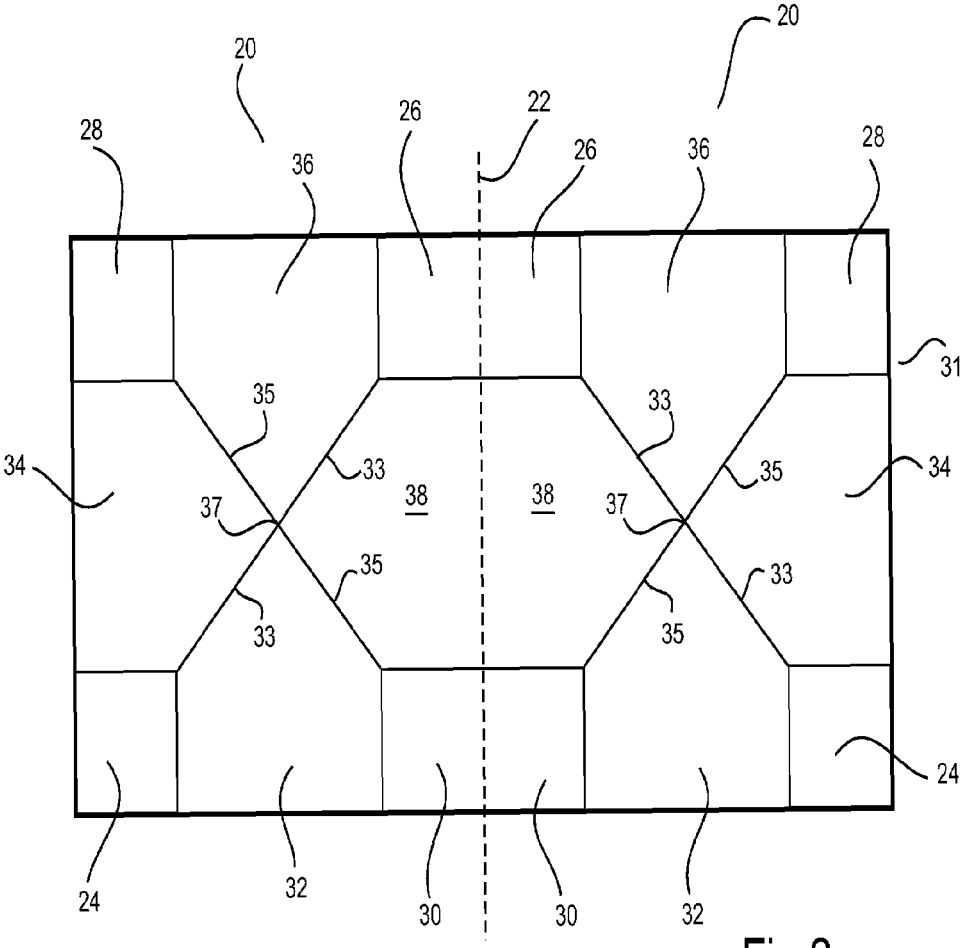
FIG. 2 is a top plan view of the construction block of FIG. 1.

The high horizontal bearing surfaces 24, 26 can be described as outermost bearing surfaces of the first end 12. The low horizontal bearing surfaces 28, 30 can be described as innermost bearing surfaces of the first end 12. Each of the outermost and innermost bearing surfaces is located about a periphery 31 of the first end 12. Each of the engaging portions 20 has four planar angled bearing surfaces. When viewed from above, as shown in FIG. 2, each of these surfaces lies within a quarter of the engaging portion 20 defined by diagonal lines.

The first angled surface 32 lies in the quarter defined by the first high horizontal bearing surface 24 and the second low horizontal bearing surface 30. The angle $\alpha$ between the first high horizontal bearing surface 24 and the first angled bearing surface 32 is a function of the difference in heights $\Delta h$ between the horizontal bearing surfaces, with $\tan(180°-\alpha)=\Delta h/(w/2)$, w being the width of the block 10.

The second angled surface 34 lies in the quarter defined by the first high horizontal bearing surface 24 and the first low horizontal bearing surface 28. The third angled surface 36 lies in the quarter defined by the second high horizontal bearing surface 26 and the first low horizontal bearing surface 28. The fourth angled surface 38 lies in the quarter defined by the second high horizontal bearing surface 26 and the second low horizontal bearing surface 30.

Adjacent angled bearing surfaces form a ridge 33 along the diagonal between the high horizontal bearing surfaces 24, 26, and a valley 35 along the diagonal between the low horizontal bearing surfaces 28, 30. The centre 37 of the engaging portion 20 is a point of inflection.

The arrangement of the bearing surfaces of the two engaging portions 20 is mirror-imaged about the dividing line 22. The respective second high horizontal bearing surfaces 26 of the two engaging portions 20 are continuous, as are the respective second low horizontal bearing surfaces 30 and the respective fourth angled surfaces 38.

The second end 14 is formed identically to the first end 12, such that if the block 10 were inverted it would appear identical. The arrangement of high and low bearing surfaces on the second end 14 are such that the first side walls 16 of the block 10 are both symmetrical about two lines of symmetry: a vertical line (aligned with the dividing line 22) and a horizontal line on symmetry. In other words, if the average height of the block is h, the height of the block beneath the high horizontal bearing surfaces 24, 26 is $h+\Delta h$, whereas the height beneath the low horizontal bearing surfaces 28, 30 is $h-\Delta h$.

The first end 12 of the block 10 is thus not complementary in shape to the second end 14 of the block 10. On the other hand, each of the engaging portions 20 of the first end 12 of the block 10 is complementary in shape to the other of the engaging portions of the second end 14 of the block 10. In other words, the first end 12 of the block 10 is complementary to the second end 14 when offset by half the length of the block 10.

It will also be apparent that the block 10 is symmetrical about a horizontal plane of symmetry.

Figure 3:
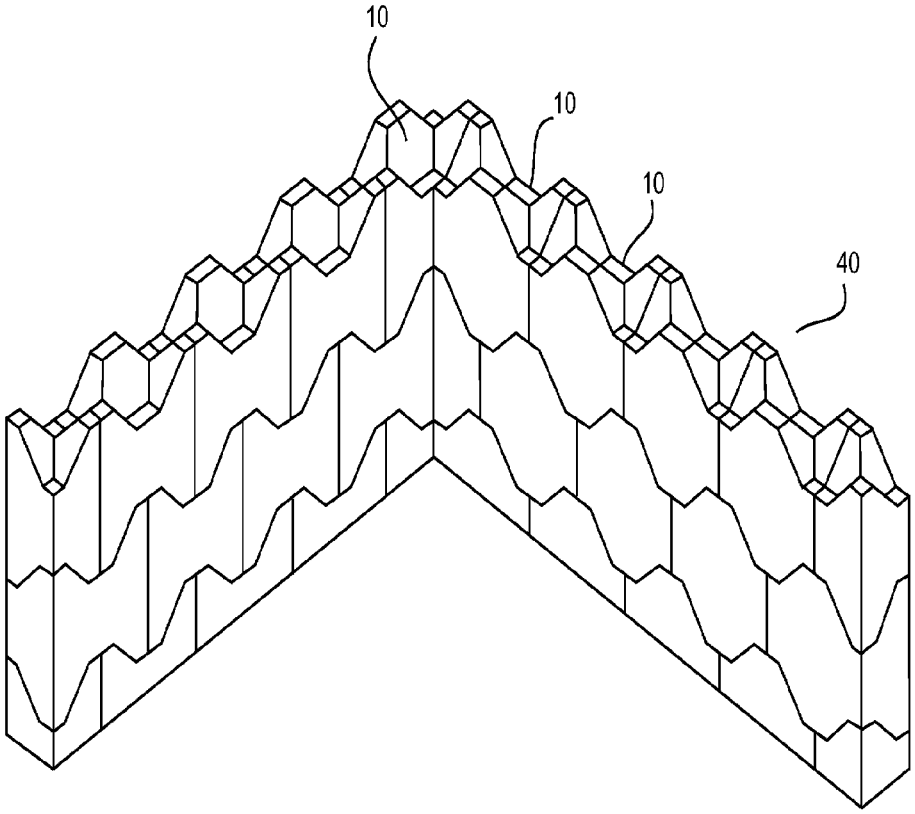
FIG. 3 is a perspective of a corner of a building constructed with the blocks of FIG. 1.

The usefulness of this arrangement in construction can be seen in FIG. 3, which shows a corner of a building 40 constructed with construction blocks 10. It will be seen that successive courses of blocks 10 are offset by half the length of a single block 10, creating a fully interlocked structure.

In addition, it can be seen that as each engaging portion is symmetrical about each of its diagonal, respective engaging portions 20 of the first end 12 and second end 14 are complementary when relatively rotated by 90°. The corner shown in FIG. 3 can therefore be created without the need for other types of block.

Figure 4:
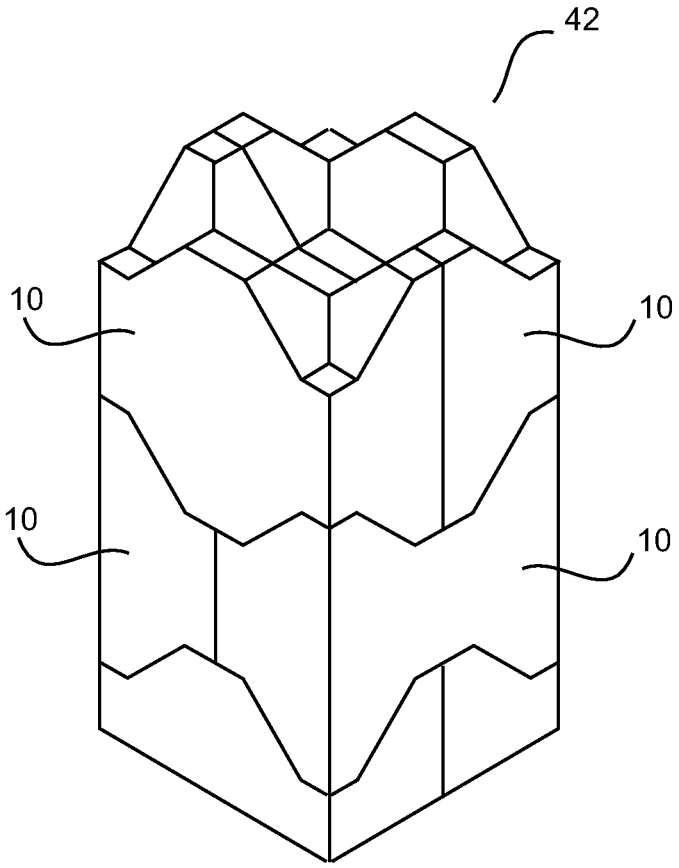
FIG. 4 is a perspective of a portion of a column constructed with the blocks of FIG. 1.
Figure 5A:
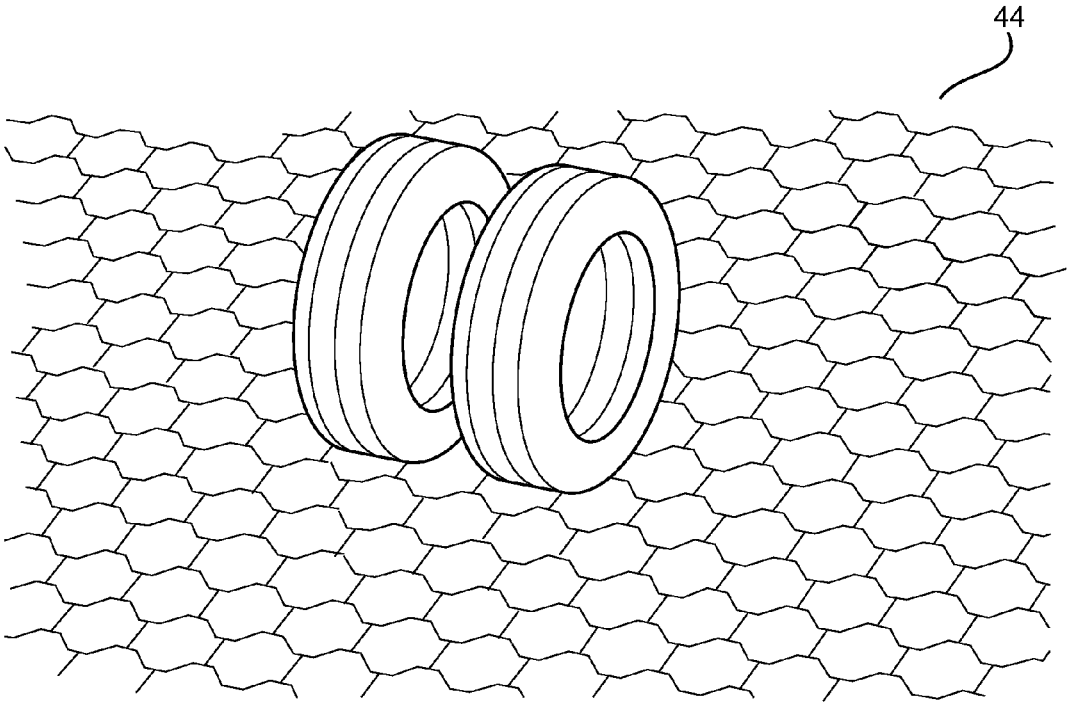
FIG. 5(*a*) is a perspective of a portion of paving using the blocks of FIG. 1.
Figure 5B:
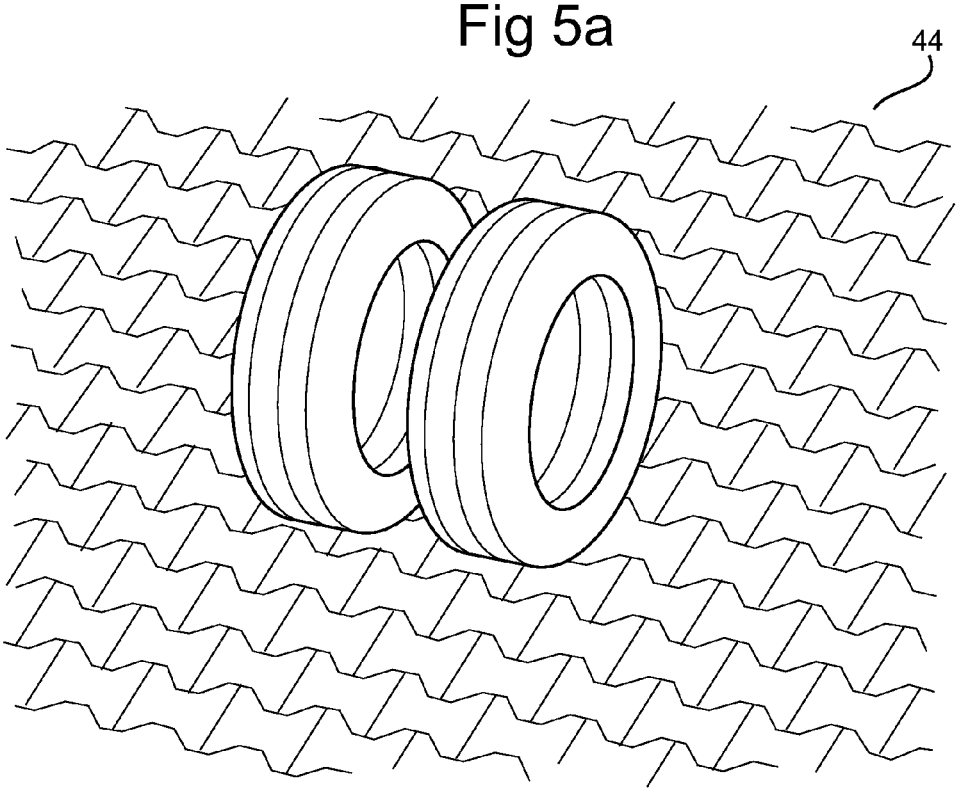

Other useful arrangements will be apparent. FIG. 4 shows a column 42 built entirely from interlocking blocks 10. FIGS. 5(*a*) and 5(*b*) show two possible arrangements of paving 44 using interlocking blocks 10.

It will be appreciated that when correctly constructed each of the bearing faces will abut a bearing face of another block, allowing load to be distributed across the end of the block. Where adjacent blocks are not properly aligned, not all of the bearing faces will be in a position to transfer load. Due to the use of planar surfaces, however, at least one pair of surfaces will be abutting, and able to distribute load across the abutting surface area. This is in contrast to curved topological surfaces, where misalignment generally results in a point load.

Figure 6:
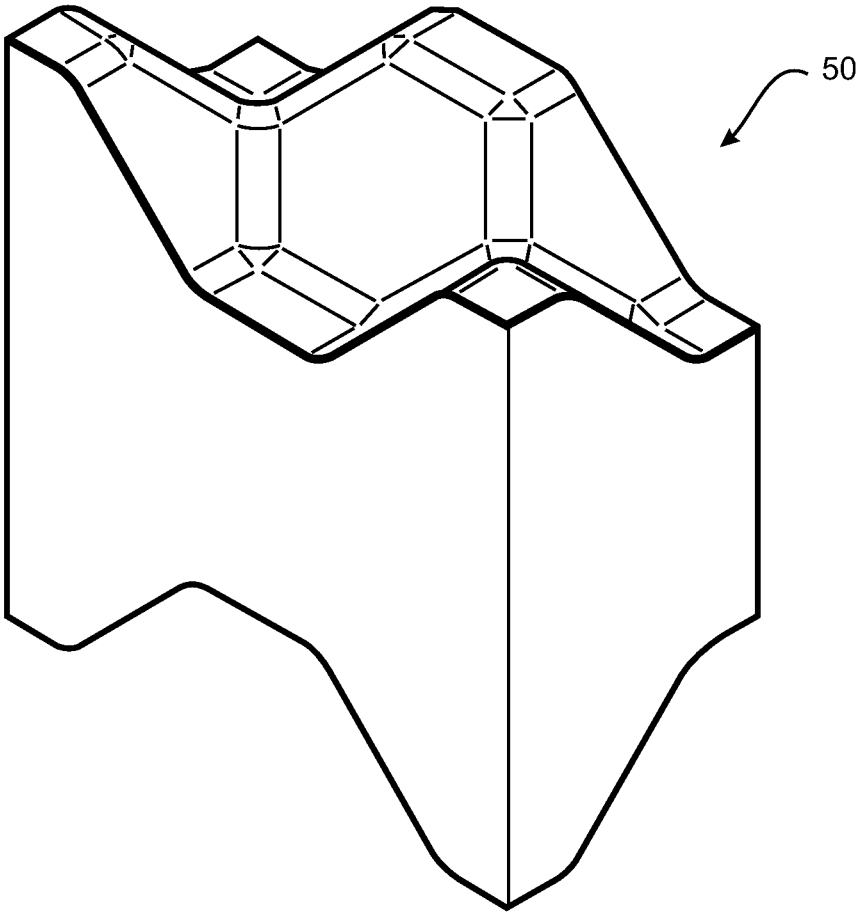
FIG. 6 is a perspective of an alternative construction block in accordance with the present invention.

Other embodiments of the present invention provide further advantages. FIG. 6 shows an alternative construction block 50 where the edges between adjoining bearing surfaces have been rounded to assist in construction.

Figure 7:
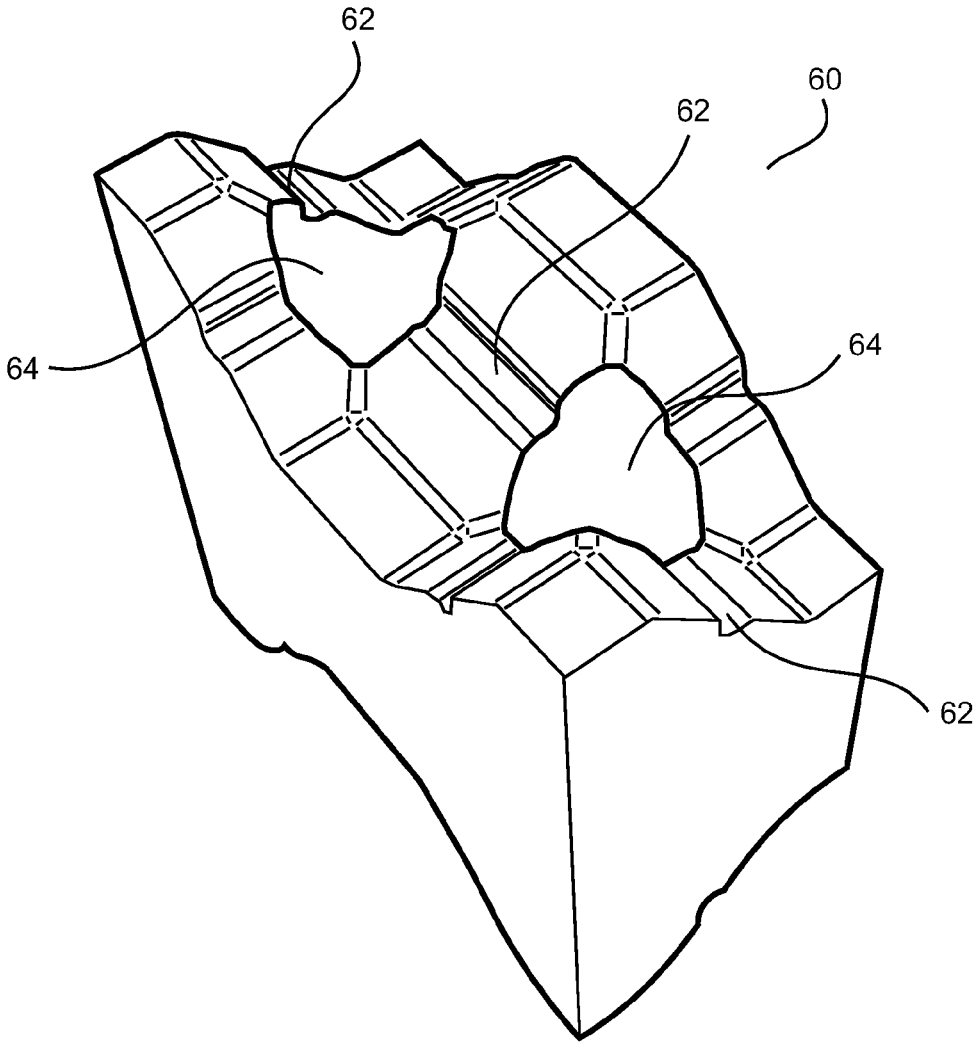
FIG. 7 is a perspective of a further alternative construction block in accordance with the present invention.
Figure 8:
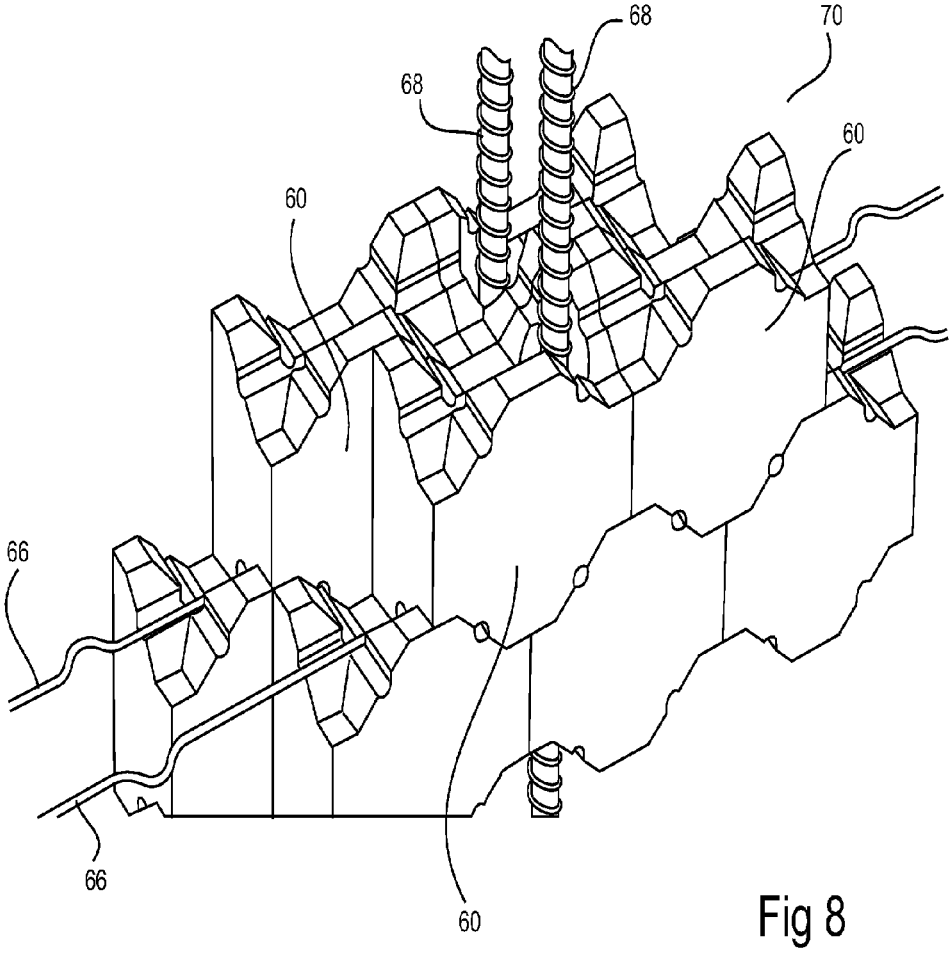
FIG. 8 is a perspective of a portion of a double-leaf wall formed using the construction blocks of FIG. 7.
Figure 9:
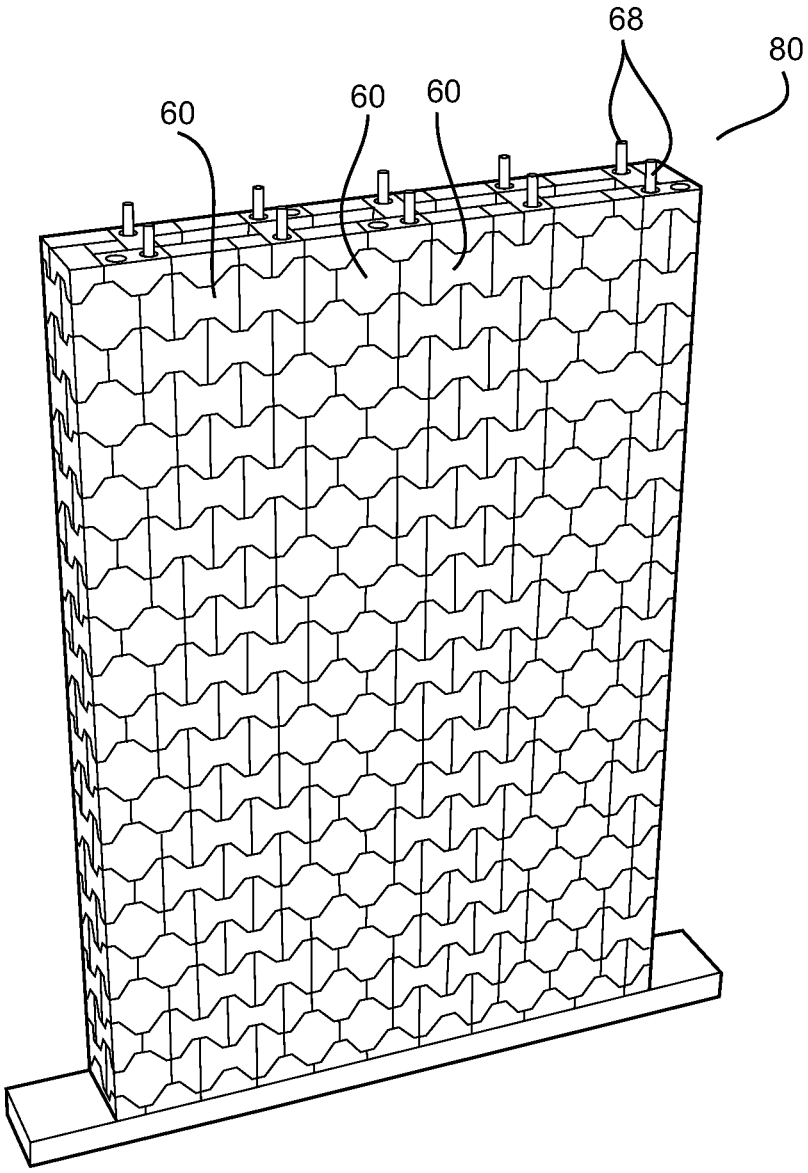
FIG. 9 is a perspective of a portion of a cavity wall formed using the construction blocks of FIG. 7.

FIG. 7 shows a further alternative construction block 60 having horizontal grooves 62 extending midway along each angled bearing surface into which horizontal rebars 66 can be received, and vertical slots 64 though the centre of each engaging portion 20 through which vertical rebars 68 can be received. These versions allow for stronger structures to be built using the construction blocks. Examples include double-leaf walls 70 such as that of FIG. 8 and cavity walls 80 such as that of FIG. 9.

The construction block shown in FIGS. 1 to 9 is a specific example of a more general style of block. Such a block is characterised by having an upper surface defined according to the equation:

$$z_1(x,y)=\Delta h\phi(x)\phi(y)+h$$

and a lower surface defined according to the equation:

$$z_2(x,y)=\Delta h\phi(x+\alpha)\phi-h$$

where h is the average height of the block above its midline; $\Delta h$ is the difference between average height and top height of the block; $\alpha$ is the block width (so $2\alpha$ is block length) and $\phi(x)$ is any function satisfying the following conditions of symmetry, periodicity, and boundary:

$$\phi(x)=\phi(-x);\ \phi(x)=\phi(x+2\alpha);\ \phi(0)=1;\ \phi(\alpha)=-1;\ \phi'(0)=\phi'(\alpha)=0.$$

Expressed in these terms, the block of FIG. 1 has an upper surface defined as follows:

$$z(x, y) = h + \Delta h$$

for $$0 \le x \le 0.25a,\ 0 \le y \le 0.25a;\ 1.75a \le x \le 2a,\ 0 \le y \le 0.25a;$$

and $$0.75a \le x \le 1.25a,\ 0.75a \le y \le a;$$

$$z(x, y) = h - \Delta h$$

for $$0 \le x \le 0.25a,\ 0.75a \le y \le a;\ 1.75a \le x \le 2a,\ 0.75a \le y \le a;$$

and $$0.75a \le x \le 1.25a,\ 0 \le y \le 0.25a;$$

$$z(x, y) = 4\Delta h\frac{(0.5a - x)}{a} + h$$

for $$0.25a \le x \le 0.75a,\ 0 \le y \le 0.5a,\ x \ge y,\ x \le a - y;$$

$$z(x, y) = 4\Delta h\frac{(x - 0.5a)}{a} + h$$

for $$0.25a \le x \le 0.75a,\ 0.5a \le y \le a,\ x \le y,\ x \ge a - y;$$

$$z(x, y) = 4\Delta h\frac{(0.5a - y)}{a} + h$$

for $$0.25a \le y \le 0.75a,\ 0 \le x \le 0.5a,\ x \le y,\ x \le a - y;$$

-continued $$z(x, y) = 4\Delta h\frac{(y - 0.5a)}{a} + h$$

for $$0.25a \le y \le 0.75a,\ 0.5a \le x \le 1.5a,\ x \ge y,\ x \ge a - y,$$

$$x \le y + a,\ x \le 2a - y;$$

$$z(x, y) = 4\Delta h\frac{(x - 1.5a)}{a} + h$$

for $$1.25a \le x \le 1.75a,\ 0 \le y \le 0.5a,\ x \ge y + a,\ x \le 2a - y;$$

$$z(x, y) = 4\Delta h\frac{(1.5a - x)}{a} + h$$

for $$1.25a \le x \le 1.75a,\ 0.5 \le y \le a,\ x \le y + a,\ x \ge 2a - y;$$

$$z(x, y) = 4\Delta h\frac{(0.5a - y)}{a} + h$$

for $$0.25a \le y \le 0.75a,\ 1.5a \le x \le 2a,\ x \ge y + a,\ x \ge 2a - y;$$

Figure 10:
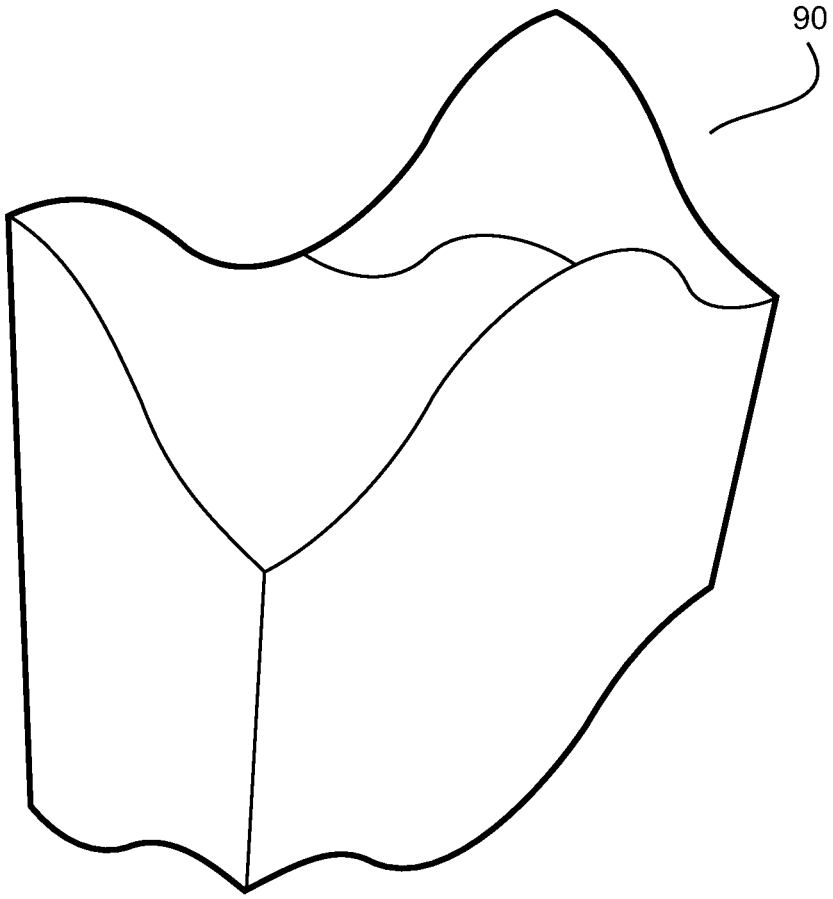
FIG. 10 is a perspective of a construction block formed according to similar principles to that of the present invention.

FIG. 10 shows an alternative construction block 90 which employs a curvilinear surface defined according to the equation:

$$z(x, y) = \frac{A'\left(\sqrt{r^2 - (x - B'a)^2} - r + 0.5\Delta h\right)\left(\sqrt{r^2 - (y - C'a)^2} - r + 0.5\Delta h\right)}{0.5\Delta h}$$

where $A'=1$ for $0\le x\le 0.5\alpha, 1.5\alpha\le x\le 2\alpha$ and $0\le y\le 0.5\alpha$, $0.5\alpha\le x\le\alpha.5\alpha$ and $0.5\alpha\le y\le\alpha$;

$A'=1$ for $0.5\alpha\le x\le 1.5\alpha$ and $0\le y\le 0.5\alpha, 0\le x\le 0.5\alpha$, $1.5\alpha\le x\le 2\alpha$ and $0.5\alpha\le y\le\alpha$;

$B'=0$ for $0\le x\le 0.5\alpha$ and $0\le y\le\alpha$;

$B'=1$ for $0.5\alpha\le x\le 1.5\alpha$ and $0\le y\le\alpha$;

$B'=2$ for $1.5\alpha\le x\le 2\alpha$ and $0\le y\le\alpha$;

$C'=0$ for $0\le x\le 2\alpha$ and $0\le y\le 0.5\alpha$; and $C'=1$ for $0\le x\le 2\alpha$ and $0.5\alpha\le y\le\alpha$;

This block has many of the properties of the construction block of FIGS. 1 to 9, with the principle difference being the propensity for point loads when successive blocks are misaligned.

Modifications and variations as would be apparent to a skilled addressee are deemed to be within the scope of the present invention.

The invention claimed is:

1. A construction block having a first end and a second end; each of the first end and the second end having a plurality of substantially planar bearing surfaces, at least two of the bearing surfaces being relatively disposed at an obtuse angle, wherein an engaging portion of the first end of a first block is complementary in shape to an engaging portion of the second end of a second block and whereby the first end of the block includes an outermost bearing surface furthest from the second end and an innermost bearing surface closest to the second end, both the innermost bearing surface and the outermost bearing surfaces being adjacent a periphery of the first end, the innermost bearing surface having at least two intermediate bearing surfaces, each of said at least two intermediate bearing surfaces being joined to the innermost bearing surface along an edge, the two intermediate bearing surfaces being joined to each other along an edge and being relatively disposed at an obtuse angle, each of the two intermediate bearing surfaces being disposed to the innermost bearing surface at an obtuse angle.

2. A construction block as claimed in claim 1, wherein the block has a length which is twice its width, and whereby the engaging portions can be engaged when the first block is offset relative to the second block by half the block's length.

3. A construction block as claimed in claim 1, wherein each engaging portion is symmetrical about a diagonal, such that the first block can be arranged to be perpendicular to the second block with the engaging portions in engagement.

4. A construction block as claimed in claim 1, whereby adjoining engagement portions are reflected about the middle of a block, such that the bearing surfaces located along the middle of a block end are substantially continuous between the two engagement portions

5. A construction block as claimed in claim 1, wherein some of the bearing surfaces are substantially perpendicular to side walls of the block and are horizontal when the side walls are vertical.

6. A construction block as claimed in claim 5, wherein the horizontal bearing surfaces are located at two heights, with angled bearing surfaces extending between horizontal surfaces at different heights.

7. A construction block as claimed in claim 6, wherein each engaging portion has two highest horizontal bearing surfaces being outermost bearing surfaces, located at diagonally opposed corners of the engaging portion; and two lowest horizontal bearing surfaces being innermost bearing surfaces, located at the other corners of the engaging portion.

8. A construction block as claimed in claim 5, wherein the horizontal bearing surfaces are square, with a side length equal to one quarter of the block width.

9. A construction block as claimed in claim 1, wherein each engaging portion has a meeting point at which at least four bearing surfaces meet.

10. A construction block as claimed in claim 9, wherein the meeting point is a point of inflexion.

11. A construction block as claimed in claim 1, wherein the block is symmetrical about a plane of symmetry located midway between the first end and the second end.

* * * * *